United States Patent [19]

Axup

[11] Patent Number: 4,822,048

[45] Date of Patent: Apr. 18, 1989

[54] MIX AND DISPLAY CHANCE DEVICE

[76] Inventor: Austin H. Axup, 1065 - 108th Ave. Bellevue #4, Bellevue, Wash. 98007

[21] Appl. No.: 72,862

[22] Filed: Jul. 14, 1987

[51] Int. Cl.[4] ..... A63B 71/00

[52] U.S. Cl. ..... 273/144 B

[58] Field of Search ..... 273/144 R, 144 A, 144 B, 273/142 E, 142 F, 142 G

[56] References Cited

U.S. PATENT DOCUMENTS

| | | | |
|---|---|---|---|
| 1,506,715 | 8/1924 | Ordway | 273/144 B |
| 2,185,366 | 1/1940 | Bartholomew | 273/144 |
| 2,216,526 | 10/1940 | Watson | 273/144 |
| 2,665,915 | 1/1954 | Steig | 273/144 |
| 2,752,725 | 7/1956 | Unsworth | 273/144 B |
| 2,844,376 | 7/1958 | Purdy | 273/144 |
| 3,289,321 | 12/1966 | Sussman | 35/10 |
| 3,589,728 | 6/1971 | McFarland | 273/134 |
| 3,853,324 | 12/1974 | Reiner et al. | 273/142 E |
| 4,123,051 | 10/1978 | Tsacoyannis | 273/1 |
| 4,373,728 | 2/1983 | Korzenietz | 273/144 |
| 4,616,831 | 10/1986 | Testerman | 273/144 |

FOREIGN PATENT DOCUMENTS

| | | | |
|---|---|---|---|
| 2460693 | 3/1981 | France | 273/144 B |
| 2519259 | 7/1983 | France | 273/144 B |
| 0278018 | 1/1952 | Switzerland | 273/144 B |
| 0743309 | 1/1956 | United Kingdom | 273/144 B |

*Primary Examiner*—Leonard E. Smith
*Assistant Examiner*—Eugene L. Szczecina, Jr.
*Attorney, Agent, or Firm*—Delbert J. Barnard

[57] ABSTRACT

The chance device (10, 10″, 10‴) has opposite end sections (12, 14, 70, 72) which are each identical to the other. In use, the device (10, 10″, 10‴) is inverted. Heavy balls (62) are caused by the inversion to drop downwardly, including through a ball passageway (44), and from the ball passageway (44) into certain ones of ball catch regions (52, 84, 86). The balls (62) are mixed as the device (10, 10″, 10‴) is inverted, so that the particular ball catch regions (52, 84, 86) into which they fall are entirely determined by chance. In another embodiment (10′), an oil (64) or other liquid is located within the chambers and the passageways and the balls (66) are buoyant. When the device (10′) is inverted, the balls (66) float upwardly into the ball catch regions (52) located at the top of the device (10′).

15 Claims, 4 Drawing Sheets

MIX AND DISPLAY CHANCE DEVICE

TECHNICAL FIELD

This invention relates to a device for making a random number selection which, by way of example, may be used to aid participants in lotteries to pick winning number combinations.

BACKGROUND ART

Lottery participants use various ways of selecting combinations of numbers. For example, some use numbers which are derrived from statistics personal to them or members of their family, such as ages, birth dates, telephone numbers, addresses, etc. Others attempt to derrive systems based on relationships of the numbers themselves, e.g. every other odd number in a series. Others attempt to make an entirely arbitrary selection. In some states it is possible to select number combinations by use of a computer to which access is provided at the places where lottery tickets are sold.

The object of the present invention is to provide a mix and display type device for selecting numbers, the operation of which is both quick and entertaining. Known devices for selecting numbers or game pieces, or a combination of numbers or game pieces, are disclosed by the following U.S. Pat. Nos.: 1,506,715, granted Aug. 26, 1924, Frank L. Ordway; 2,185,366, granted Jan. 2, 1940, to Harvey C. Bartholomew; 2,216,526, granted Oct. 1, 1940, James H. Watson; 2,665,915, granted Oct. 1, 1940, to James H. Watson; 2,665,915, granted Jan. 12, 1954, to William Steig; 2,884,376, granted July 22, 1958, to Harry W. Purdy; 3,289,321, granted Dec. 6, 1966, to Martin D. Sussman; 3,589,728, granted June 29, 1971, to Normal McFarlane; 4,123,051, granted Oct. 31, 1978, to Hedwig R. Tsacoyannis; 4,373,728, granted Feb. 15, 1983, to Willi Korzenietz; and 4,616,831, granted Oct. 14, 1986, to Ronald D. Testerman.

U.S. Pat. No. 4,373,728 is the only patent of the group which discloses a device designed to pick a particular set of numbers from a particular group of numbers. Such patent discusses, for example, picking six numbers out of a possible forty numbers. The device disclosed by this patent is quite complicated and takes a considerable amount of time to make the selection. This is because it handles a number of balls equal to the numbers involved in the group (e.g. forty numbers) and places them one at a time into pockets formed at the periphery of a wheel. Six of the balls are of a first color and the remaining balls are of a second color. The balls are all mixed in a mixing chamber and are then fed out of the mixing chamber, one at a time, into positions to be fed into the pockets at the periphery of the wheel. The wheel is turned to successively expose the pockets to the balls being fed out from the mixing chamber. A ball drops into each pocket as the pocket rotates into alignment with a ball delivery tube. After all of the balls are in the pockets, numbers associated with the pockets in which the six balls of the first color are received are read. This is the number combination that was selected in the manner described.

The mix and display device of the present invention handles only a number of balls equal to the set of numbers to be selected. The balls are mixed and distributed by a simple inversion of the device. As they drop the balls are randomly distributed to a like number of pockets in a group of pockets equal to the group of numbers involved in the lottery. For example, in the lottery operated by the state of Washington, seven numbers are selected out of forty-four numbers. Thus, in my device, there are six balls and forty-four pockets.

DISCLOSURE OF THE INVENTION

The mix and display type chance device of the invention is basically characterized by a plurality of ball catch regions at an end of the device. Each ball catch region includes a closed end and an open end. A ball passageway communicates with the open ends of the ball catch regions. An identifying indicia (e.g. a number) is associated with each ball catch region. A predetermined number of balls are located in the device and are movable into and out from the ball catch regions, and through said ball passageway, in response to an inversion of the device. The device can be positioned with the closed end of the ball catch regions directed upwardly and the open ends of the ball catch regions directed downwardly. This positions the balls by gravity at a lower location in the device spaced from the ball catch regions. Then, the device can be inverted to cause the balls to gravitate through the ball passageway, and mix as they move, and each move into a said ball catch region.

According to an aspect of the invention, the device may be constructed to have opposite end portions which are identical. Thus, each time the device is inverted, the balls will move through the device and mix and eventually settle into ball catch regions at the new lower end of the device.

In accordance with another aspect of the invention, the device can be filled with a liquid (e.g. oil) and the balls can be made from a buoyant material. Inversion of this type of device causes the balls to float upwardly through the liquid, and mix as they move, and eventually settle into ball catch regions at the upper end of the device.

In accordance with yet another aspect of the invention, the device may have like end portions, but divided at its center into two separate number selection portions. Such device may include a transverse center wall and a pair of mixed chambers, one on each side of the transverse wall. Each mix chamber may communicate with the ball passageway at its end of the device. Inversion of a device of this type will cause the balls in the ball catch regions at the bottom of the device (or at the top in a device including a liquid, and buoyant balls) to move into the mix chamber at their end of the device. The balls at the other end of the device move out from their mix chamber into the ball catch regions at their end of the device.

The invention also involves various constructional features which are hereinafter described in detail as a part of the description of the best mode of the invention.

BRIEF DESCRIPTION OF THE DRAWING

In the drawing, like reference numerals are used to designate like parts throughout the several views of the drawing, and.

BEST MODE FOR CARRYING OUT THE INVENTION

Figure 2:
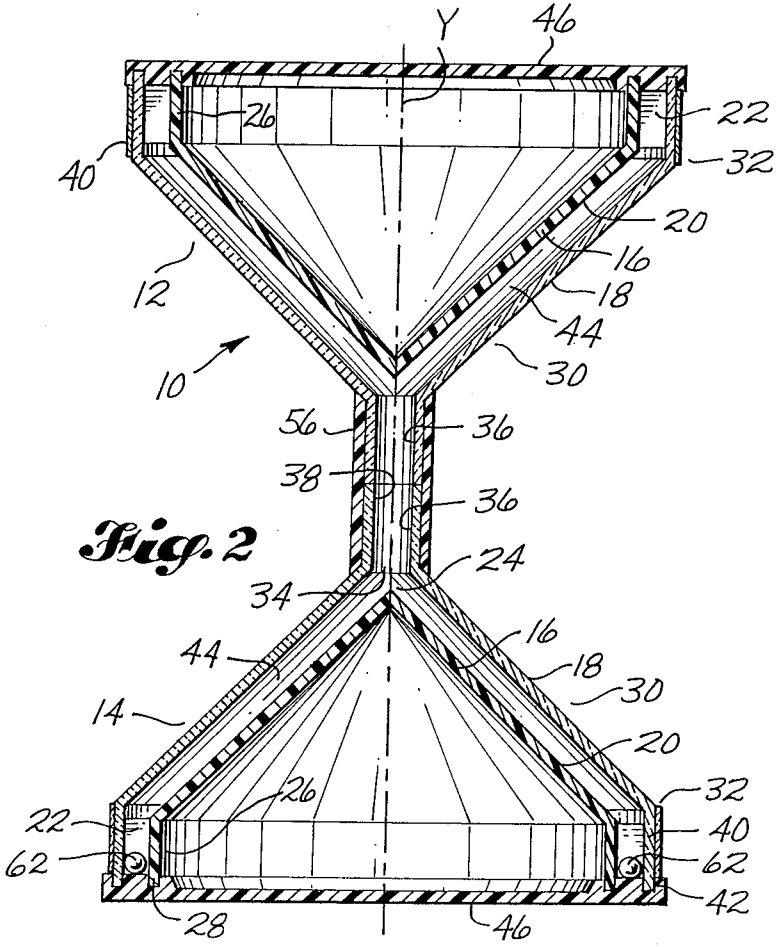
FIG. 2 is an enlarged scale vertical sectional view of the embodiment shown by FIG. 1.
Figure 1:
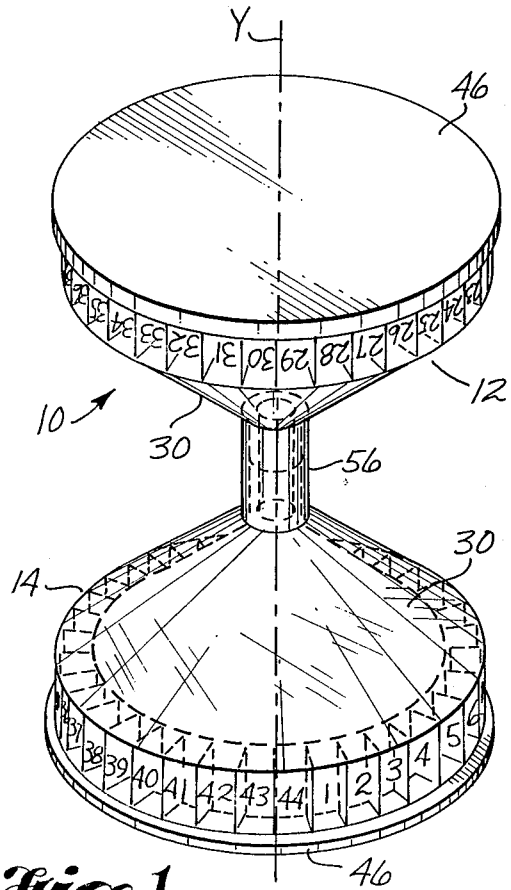
FIG. 1 is an isometric view of a first embodiment of the invention.

Referring to FIGS. 1 and 2, a mix and display type chance device 10, constructed in accordance with the present invention, may comprise identical opposite end sections 12, 14. Each end section 12, 14 comprises wall means defining a plurality of ball catch regions spaced about an axis y. Axis y is a geometrical centerline axis of the device 10.

As illustrated, each end portion 12, 14 may comprise concentric walls 16, 18. Inner wall 16 may comprise a conical portion 20 having a base 22 and an apex 24. The base 22 may connect to, or be formed integral with, an inner end of a cylindrical sidewall portion 26. The outer end of the cylindrical sidewall portion 26 terminates in an edge 28.

Outer wall 18 may include a conical section 30 having a large diameter end 32 and a small diameter end 34. Small diameter end 34 may be connected to, or formed integral with, the outer end of a small diameter tube 36. The inner end 38 of the tube 36 has an edge which abuts a like edge of the tube 36 of the opposite end portion 12, 14 of the device 10. Large diameter end 32 connects with or is formed integral with an inner end of a cylindrical wall 40. Cylindrical wall 40 has an outer end which terminates in an edge 42. The inner and outer wall sections 20, 30 define between them a ball passageway 44. Ball passageway 44 has a small end where it meets the interior of tube 36 and a large end where wall 20 meets wall 26 and wall 30 meets wall 40.

Figures 4, 5, 6, 7, 8:
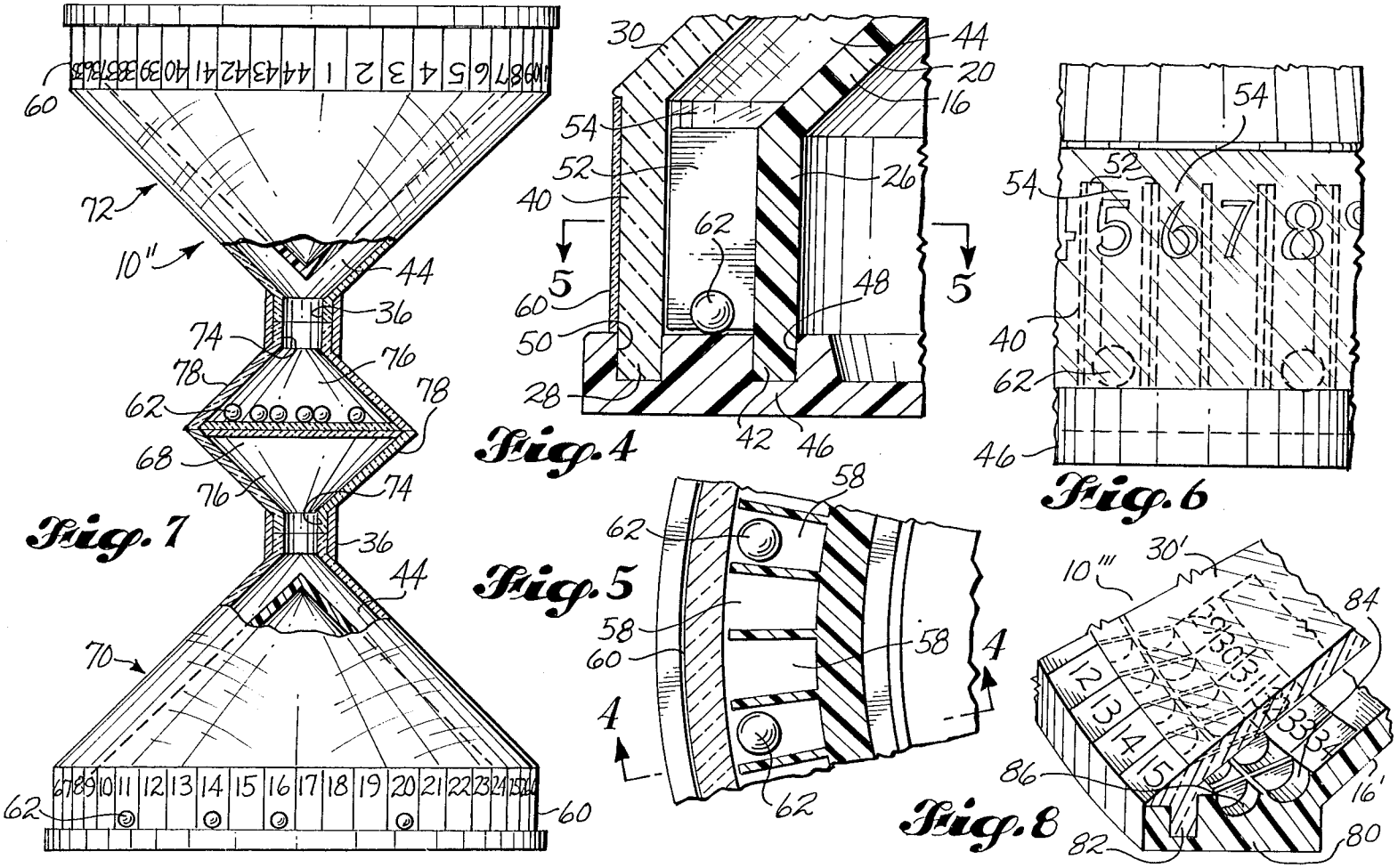
FIG. 4 is an enlarged scale sectional view of a lower side region of FIG. 2, taken substantially along line 4—4 of FIG. 5.
FIG. 5 is a fragmentary sectional view taken substantially along 5—5 of FIG. 4.
FIG. 6 is a fragmentary elevational view looking towards the outside of the fragment shown by FIGS. 4 and 5.
FIG. 7 is an elevational view of a second embodiment, with the central portion of the embodiment shown in vertical section.
FIG. 8 is a fragmentary isometric view of a lower peripheral portion of a third embodiment of the invention.
Figure 10:
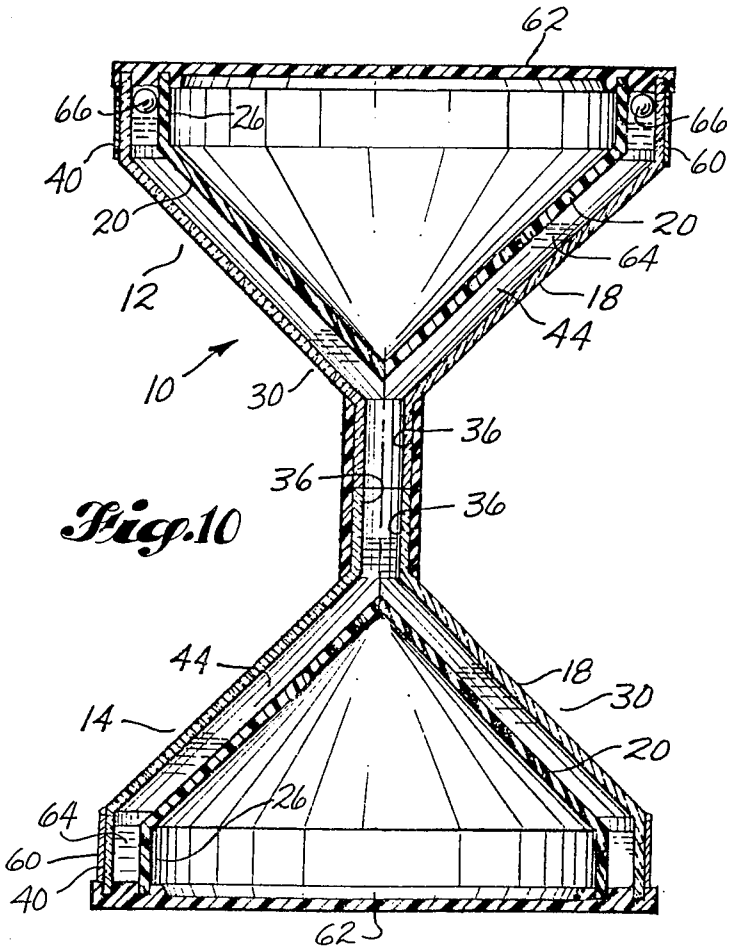
FIG. 10 is a view like FIG. 2, but of the device of FIG. 1.
Figure 9:
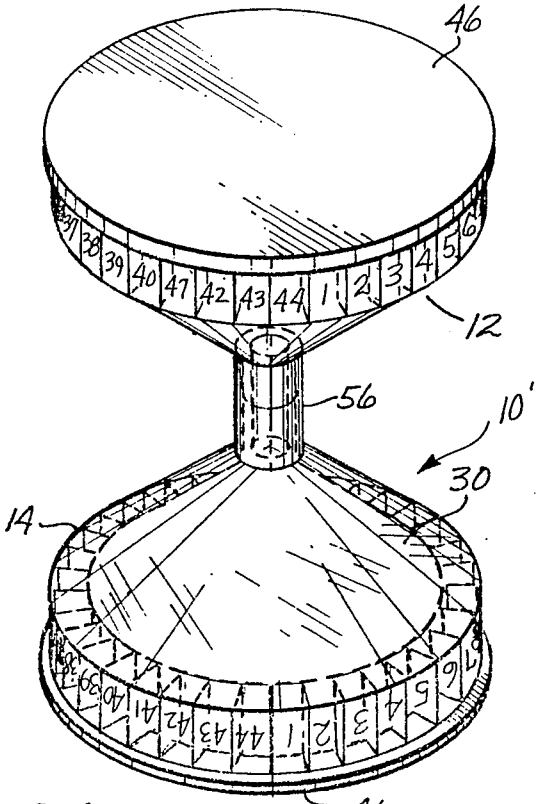
FIG. 9 is a view like FIG. 1, but of a device containing a liquid, and buoyant balls.

In the embodiment of FIGS. 1-6, and the embodiment of FIGS. 9 and 10, an end wall 46 is provided at each end of the device 10. This end wall 48 comprises concentric inner and outer grooves 48, 50 in which the edge portions 28, 42 are received (FIG. 4).

Figure 3:
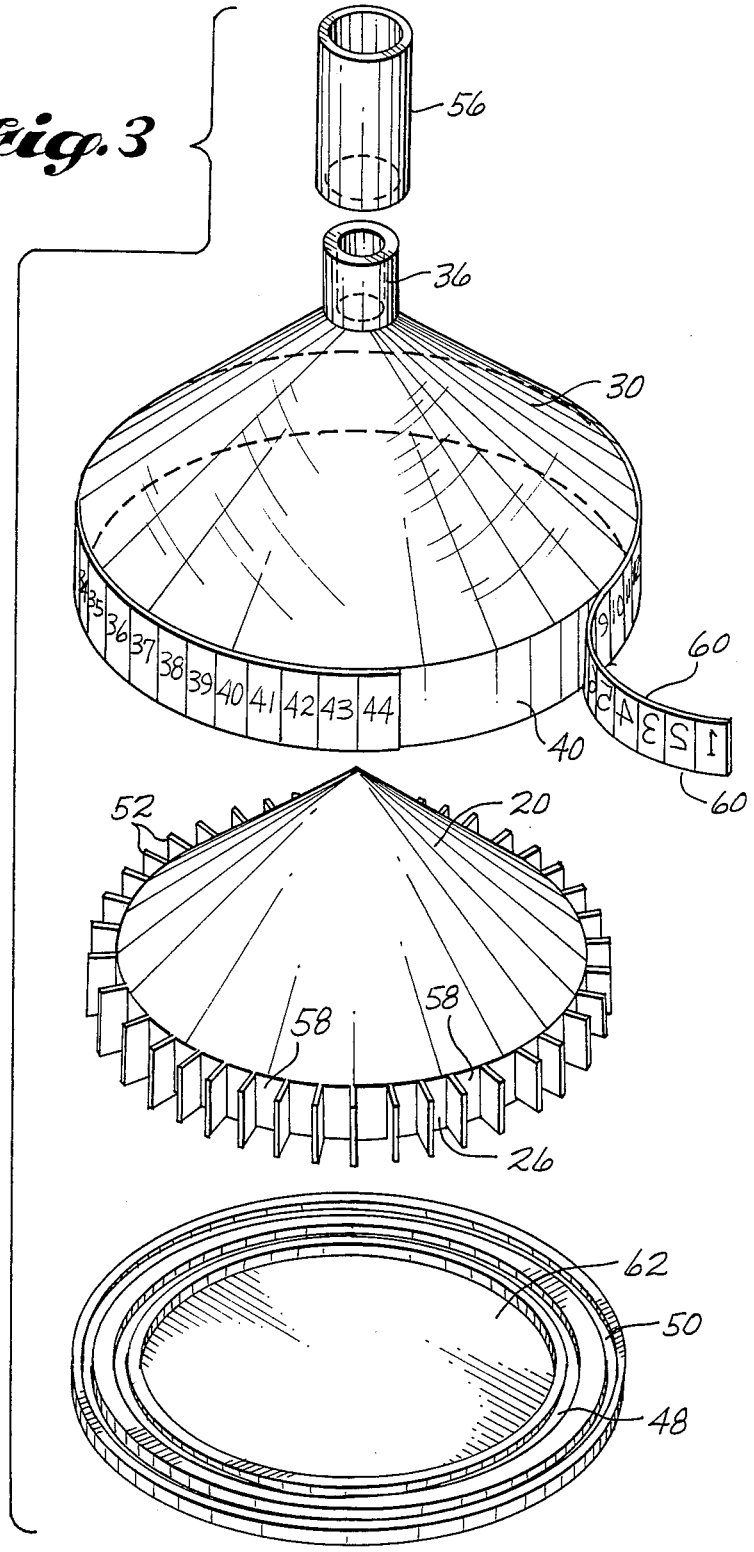
FIG. 3 is an exploded isometric view of one end portion of the embodiment shown by FIGS. 1 and 2.

As best shown by FIG. 3, wall section 26 may be formed to include a plurality of radially extending divider walls, some of which are designated 52. When the device 10 is assembled, the divider walls 52 extend radially outwardly from cylindrical wall 26, substantially to a point of contact with cylindrical wall 40. The radial walls 52 divide an annular space 54, which is defined radially by and between the walls 26, 40, and which is closed at one end by the end wall 46, into a plurality of ball catch regions or pockets 58.

A splice tube 56 may surround the tubes 36 and serve to connect the two end portions 12, 14 together.

In FIGS. 1-6, 9 and 10, the parts 16, 26, 46 and 56 are shown to be constructed from an opaque material. Parts 18, 36, 40 are shown to be constructed from a transparent material. In preferred form, all parts of the device 10 are constructed plastic. The opaque regions may be constructed from a colored plastic. The trasparent regions are constructed from a clear or transparent plastic. The various parts may be glued together where they come together.

An identifying indicia is associated with each of the ball catch regions or pockets 58. As shown by FIG. 3, this may be done by printing a separate number for each pocket 58 onto a band 60 of clear plastic material and then gluing such band 60 onto the outer surface of cylindrical wall 40. The transparent nature of the material 60 will allow one to look through it into the pockets 58.

In accordance with the invention, a plurality of balls 62 are located inside the device. The inner space of the device 10, comprising the ball catch regions 52, the ball passageways 44, and the insides of the tubes 36, may be filled with air and the balls 62 may be constructed from a relatively heavy material. This is what is illustrated in FIGS. 1-6.

By way of example, the device may contain six balls 62 and forty-four ball catch regions.

In use, the device 10 is simply inverted. The inversion causes a change in position of the two end portions. The balls 62 are initially in a bottom position. This inversion causes the balls 62 to move out of the ball catch regions 58 that they were in into the adjoining ball passageway 44. Once in passageway 44 they run into the tubes 36 at the center of the device 10. During the inversion the balls 62 pass from the once lower tube 36 into the second tube 36 when it takes the lower position. They then flow into the new lower ball passageway 44. Movement of the balls 62 from one end of the device 10 to the other causes them to be mixed-up. Eventually they will move from the ball passageway 44 that has been placed into the lower position, into certain ones of the adjoining ball catch regions 52. The user then reads the numbers associated wih the seven ball catch regions in which the seven balls 62 are received. These seven numbers become the seven numbers that have been selected by the device.

The embodiment of FIGS. 9 and 10 is like the embodiments 1-6 except that the interconnected inner spaces of the device contain an oil or other liquid 64 and the balls 66 are buoyant in such liquid. Also, the indicia is oriented on the strips 60 such that the indicia at the top of the device 10′ is rightside up and the indicia of the bottom of the device 10′ is upside down. In this embodiment, each time the device 10′ is inverted, the balls 66 will be swung by the inverting action into a lower position. Then, they will float upwardly through the liquid into ball catch regions at the top of the device 10′.

The embodiment shown by FIG. 7 is similar to the embodiment shown by FIGS. 1-6. The difference is that it is divided into two portions which are separated by a transverse center wall 68. The two end portions 70, 72 may be constructed like the end sections 10, 14, but with the tubes 36 each splice connected to a tubular end portion 74 of a mixing chamber 76. Tube 74 is connected to or formed integral with the small end of a conical wall 78. The large diameter end of the conical wall 78 is closed by the center wall 68.

When the device is in the position shown by FIG. 7, the balls 62 of the lower section 70 are located within the ball catch regions of the lower section. The balls 62 of the upper section 72 are located within mixing chamber 76. When the device is inverted, the balls 62 in section 70 will run down into the mixing chamber 76 of section 70. The ball 62 in section 72 will run out from the mixing chamber 76 of section 72, through the small tubular neck, into the ball passageway 44, and then out from ball passageway 44 into certain ones of the ball catch regions of section 72. The inversion of the device will cause some mixing of the balls 62 in the mixing chamber 76. Further mixing will occur as the balls pass through the narrow tubular passageway and the ball passageway 44 onto the ball catch regions.

FIG. 8 is a fragmentary view of an outer peripheral portion of a modified form of the device. The embodiment of FIG. 8 may be constructed like the embodiment of FIGS. 1–6 except that the end wall 46 may be replaced by an end flange 80 formed on the wall 16'. The cylindrical wall 40 may be replaced by a cylindrical lip 82 formed on the wall 30'. In this embodiment, the ball catch regions are pockets formed in the inner surface portion of the flange 80. Two rows of pockets are illustrated. The pockets of the inner roll are designated 82 and the pockets of the outer roll are designated 84. Identifying indicia for the pockets 82 may be located radially inwardly of the pockets 82 on an adjacent surface of wall 16'. Identifying indicia for the pockets 84 may be located radially outwardly of the pockets 84, on an outer wall portion of wall 30'. Of course, in another embodiment, the device could be constructed to include only a single roll of pockets within the inner surface portion of the flange 80.

The presence of two rows of pockets 84, 86 make it possible to double the number of numbers that can be selected. It also makes it possible to construct a device which can select the same number of numbers as the devices shown by FIGS. 1–7, but which is much smaller in size. In FIG. 8, the wall 16' and flange 80 are shown to be constructed from an opaque material. Wall 30' is shown to be constructed from a transparent material.

Of course, given the foregoing, one skilled in the art could be led to many other ways of constructing the device, each amounting to a utilization of the invention. The embodiments which have been illustrated and described are provided to serve as examples of the invention and they include the best mode of the invention. However, the scope of the invention and coverage of the patent are not to be determined or established by these examples, but rather are to be determined by the claims which follow, interpreted in accordance with the established rules of patent claim interpretation, including use of the doctrine of equivalents.

What is claimed is:

1. A mix and display type chance device, comprising:

wall means defining a plurality of ball catch regions spaced about an axis, each said ball catch region including a closed end and an open end;

a ball passageway which surrounds said axis, said ball passageway having a small end and a large end, said large end being positioned adjacent the open ends of the ball catch regions;

said ball passageway being defined between inner and outer conical walls, said inner wall converging to a closed top and said outer wall converging to form said small end, such that said ball passageway is axially tubular at said small end and is annular at said large end;

a ball mixing chamber axially spaced from and in communication with the small end of said ball passageway;

an identifying indicia associated with each said ball catch region; and a predetermined number of balls movable into and out from the ball catch regions, and through said ball passageway, in response to an inversion of the device, wherein the device can be positioned with the closed end of said ball catch regions directed upwardly, and the open ends of the ball catch regions directed downwardly, to position the balls by gravity in the ball mixing chamber, and then the device can be inverted to cause the balls to gravitate through the ball passageway, striking the inner wall and mixing as they move, and each into a said ball catch region.

2. A mix and display type chance device according to claim 1, wherein the wall means comprises inner and outer wall regions defining an annular space at an end of the device, radial walls dividing the annular space into a plurality of chambers, each of which constitutes one of the said ball catch regions, and an end wall region which provides the closed end for the ball catch region.

3. A mix and display type device according to claim 1, wherein said wall means comprises end wall means at the large end of said ball passageway in which a pair of concentric rows of ball receiving pockets are formed, said ball receiving pockets constituting the said ball catch regions.

4. A mix and display type chance device according to claim 1, wherein said inner and outer walls have edges at the large end of the ball passageway, and said wall means including an end wall comprising spaced-apart concentric grooves into which said edges are received, with a portion of the end wall between said grooves providing the closed ends for the ball catch regions.

5. A mix and display type chance device according to claim 4, wherein said inner wall includes a plurality of circumferentially spaced apart radial walls, said radial walls defining side boundaries of the ball catch regions.

6. A mix and display type chance device according to claim 1, wherein said inner wall comprises a flange including an outwardly spaced annular groove and said outer wall comprises an annular lip which fits into said groove, and said flange between the groove and the inner wall defines the closed ends of the ball catch region.

7. A mix and display type chance device according to claim 6, wherein the ball catch regions comprise a plurality of circumferentially spaced apart pockets formed in said flange.

8. A mix and display type chance device according to claim 7, wherein the flange includes inner and outer concentric rows of pockets.

9. A mix and display type chance device according to claim 8, comprising identifying indicia for the inner row of pockets located on the inner wall adjacent the pockets, and further comprising identifying indicia for the outer row of pockets formed on the outer wall, adjacent said outer row of pockets.

10. A mix and display type chance device having opposite end portions, each comprising:

wall means defining a plurality of ball catch regions spaced about an axis, each said ball catch region including a closed end and an open end, and a ball passageway which surrounds said axis, said ball passageway having a small end and a large end, said large end being positioned adjacent the open ends of the ball catch regions;

an identifying indicia associated with each said ball catch region; and a predetermined number of balls moved into and out from the ball catch regions and through said ball passageway in response to an inversion of the device, wherein the device can be inverted to cause the balls to each move, and mix as they move, into a said ball catch region at opposite ends of the device.

11. A mix and display type chance device according to claim 10, wherein the small ends of the ball passageways at the two ends of the device are interconnected by a tube which provides a through passageway, and the said balls pass from one end of the device to the other.

12. A mix and display type device according to claim 11, wherein the balls are made from a heavy material and each time the device is inverted the balls fall by gravity down into the new lower end portion of the device.

13. A mix and display type device according to claim 11, comprising a liquid within the ball passageways, the interconnecting passageway and the ball catch regions, and wherein said balls are constructed from a buoyant material, so that each time the device is inverted the balls will float upwardly into the upper end portion of the device, into the ball catch regions of said upper end portion.

14. A mix and display type chance device according to claim 10, comprising divider wall means between the end portions of the device, providing a separator wall between the ball passageways in the two end portions of the device, and wherein each end portion of the device comprises a plurality of balls.

15. A mix and display type chance device according to claim 14, further comprising a mixing chamber at each side of the divider wall, each said mixing chamber having a large end adjacent the divider wall and a small end which communicates with the small end of the ball passageway in each end portion of the device.

* * * * *